US012442626B2

(12) United States Patent
Cogger

(10) Patent No.: US 12,442,626 B2
(45) Date of Patent: Oct. 14, 2025

(54) TWO-PART POLYMER AMMUNITION CASING

(71) Applicant: Innovative Performance Applications, LLC, Orange, CA (US)

(72) Inventor: John Cogger, Santa Ana, CA (US)

(73) Assignee: Innovative Performance Applications, LLC, Orange, CA (US)

( * ) Notice: Subject to any disclaimer, the term of this patent is extended or adjusted under 35 U.S.C. 154(b) by 0 days.

(21) Appl. No.: 18/805,432

(22) Filed: Aug. 14, 2024

(65) Prior Publication Data

US 2024/0401919 A1 Dec. 5, 2024

Related U.S. Application Data

(63) Continuation of application No. 18/312,794, filed on May 5, 2023, now Pat. No. 12,066,279.

(60) Provisional application No. 63/364,318, filed on May 6, 2022.

(51) Int. Cl.

| | |
|---|---|
| ***F42B 5/313*** | (2006.01) |
| ***B21K 21/04*** | (2006.01) |
| ***F42B 5/02*** | (2006.01) |
| ***F42B 33/00*** | (2006.01) |

(52) U.S. Cl.

CPC ..... *F42B 5/313* (2013.01); *B21K 21/04* (2013.01); *F42B 33/001* (2013.01); *F42B 5/02* (2013.01)

(58) Field of Classification Search

CPC .... F42B 5/02; F42B 5/30; F42B 5/307; F42B 5/313; F42B 33/00; F42B 33/001; B21K 21/04

USPC ..... 102/464, 465, 466, 467

See application file for complete search history.

(56) References Cited

U.S. PATENT DOCUMENTS

| | | | | |
|---|---|---|---|---|
| 3,284,560 | A * | 11/1966 | King et al. | B29C 55/22 102/467 |
| 4,481,885 | A * | 11/1984 | Erickson | F42B 5/30 102/466 |
| 6,752,084 | B1 * | 6/2004 | Husseini | F42B 5/307 102/466 |
| 7,059,234 | B2 * | 6/2006 | Husseini | F42B 33/001 86/55 |
| 9,032,855 | B1 * | 5/2015 | Foren | F42B 33/00 102/466 |

(Continued)

FOREIGN PATENT DOCUMENTS

| | | | | |
|---|---|---|---|---|
| WO | WO-2023215622 | A1 * | 11/2023 | F42B 5/313 |

*Primary Examiner* — James S Bergin

(74) *Attorney, Agent, or Firm* — Orbit IP, LLP; Marc G. Martino

(57) ABSTRACT

A method of manufacturing a casing for an ammunition cartridge includes injection molding a first polymer forming a first part of the casing. The first part is cylindrically shaped along a longitudinal axis extending from a projectile end opposite a stepped end. The stepped end forms a first end of a mechanical connection. A portion of the injection mold is removed and an additional injection mold is disposed about the stepped end of the first end of the first part and a second polymer injected forms a second part of the casing. The second part includes a second stepped end forming a second end of the mechanical connection. The first and second end are mechanically locked together preventing a separation of the first part from the second part. A thermal swagging tool forms a conical tapered region along the projectile end of the first part.

18 Claims, 13 Drawing Sheets

(56) References Cited

U.S. PATENT DOCUMENTS

| | | | | |
|---|---|---|---|---|
| 9,200,880 | B1 * | 12/2015 | Foren | F42B 33/00 |
| 10,466,022 | B2 * | 11/2019 | Peterson | F41A 11/02 |
| 12,066,279 | B2 * | 8/2024 | Cogger | B21K 21/04 |
| 2016/0332349 | A1 * | 11/2016 | Lemke | B29C 45/4421 |
| 2021/0129224 | A1 * | 5/2021 | Skowron | B22F 3/225 |

* cited by examiner

TWO-PART POLYMER AMMUNITION CASING

CROSS-REFERENCE TO RELATED APPLICATIONS

This continuation application claims priority to non-provisional application Ser. No. 18/312,794 filed on May 5, 2023, which itself claims priority to provisional application 63/364,318 filed on May 6, 2022, the entire contents of all applications are fully incorporated herein with these references.

DESCRIPTION

Field of the Invention

The present invention generally relates to ammunition casings. More particularly, the present invention relates to an ammunition casing that is made with a polymer instead of a metal.

BACKGROUND OF THE INVENTION

Review of existing patent literature reveals over 200 patents issued for various aspects of producing polymer casings. Investigation of the details of some of these patents indicates that most or all of them relay on conventional injection molding as means of manufacture but require multipiece construction with multiple components because regions of the typical munitions cross section consist of necked down and tapered regions that will be impossible to injection mold due to the severe undercuts.

Review of these patents and associated claims leads to some common limitations. All are multi-piece casing designs due to the inherent difficulties in traditional injection molding. This requires some non-trivial means of attachment between the various pieces. Metal injection molding is claimed (MIM) with the same considerations and limitations as above. Many polymer-based resins are claimed but no reference to carbon nanotube additives or graphene platelet additives was found. Alternative projectile retention mechanisms are claimed, typically using molded in surface textures to increase surface friction. No mention can be found accommodating the inherent visco-elastic behavior of polymers under long term tension load, such as stress relaxation or creep. These phenomena conspire to the effect of loosening the projectile fit to the polymer casing over time.

Accordingly, there is a need for an improved casing utilizing polymers and not metals. The present invention fulfills these needs and provides other related advantages.

SUMMARY OF THE INVENTION

In an exemplary embodiment of the present invention, a method of manufacturing a casing (11) for an ammunition cartridge (10) is disclosed. The method comprises the steps of: providing an injection mold (22); using the injection mold, injection molding a polymer forming the casing into a first state (11*a*); wherein the casing in the first state is generally cylindrically shaped (35) along a longitudinal axis (36), the casing extending from a base (37) to a distal end (33) with a blind hole (38) formed therein, the blind hole comprising a primer retention feature (20) disposed at the base and leading into a flash hole (15), wherein the flash hole extends along a neck (38) of the casing to the distal end; placing an insulator (23) and/or reflector (24) around at least a portion of the casing separating the base from the neck; using a heater (25), directly heating the neck of the casing while not directly heating the base of the casing, the casing now in a second state (11*b*); inserting a stretch rod (27) into the blind hole and stretching the neck from a first length (41) to a second length (42), the casing now in a third state (11*c*); providing a blow mold cavity (28, 29, 30); inserting the casing in the third state into the blow mold cavity; pressurizing the blind hole with an air pressure causing the neck of the casing to be blow molded into a fourth state (11*d*), wherein the neck of the casing now comprises at least one undercut (18) circumferentially disposed about the longitudinal axis of the casing; and removing at least a portion (45) of the distal end of the casing, the casing now being in a fifth state (11*e*).

In other embodiments, the entirety of the casing in the fifth state may be made from the polymer, wherein the polymer is a single material.

The flash hole may be a smaller diameter in comparison to the primer retention feature when the casing is in the first state.

The injection mold (22) may comprise a first mold (22*a*), a second mold (22*b*) and a pull mold (22*c*), where the first mold and the second mold are configured to cooperatively form an outside surface (39) of the casing in the first state, wherein the first and second molds are configured to be separated moving apart from one another, and including a pull mold (22*c*) that is configured to form an inside surface (40) of the primer retention feature and flash hole, wherein the pull mold separates in a direction perpendicular to the first and second molds.

The blow mold cavity may comprise a first blow mold (28) and a second blow mold (29), wherein the first and second blow molds are configured to cooperatively form an inside surface (43) that matches an outside surface (44) of the casing in the fourth state.

The heater may be an infrared heater or hot air heater.

The polymer may comprise a base resin of polypropylene, polyethylene, high density polyethylene or acetal.

The polymer may comprise an additive of carbon nanotubes and graphene platelets in a percentage by weight of 0.01 to 30 percent.

The polymer may comprise a base resin of nylon, ABS, PET, polyamides, PEEK, general co-polymers, general homo-polymers.

The polymer may comprise an additive of fiberglass filled materials and/or Talc filled materials.

The polymer may not comprise PEEK.

The blow mold cavity may include at least one annular rib (34) configured to form a cannelure (19) into the fourth state of the casing.

In another exemplary embodiment of the present invention, a method of manufacturing a casing (11) for an ammunition cartridge (10) is disclosed. The method comprises the steps of: providing an injection mold (22); using the injection mold, injection molding a polymer forming the casing into a first state (11*a*); wherein the casing in the first state is generally cylindrically shaped (35) along a longitudinal axis (36), the casing extending from a base (37) to a distal end (33) with a blind hole (38) formed therein; either: a) during the injection molding of the polymer, forming the blind hole comprising a primer retention feature (20) disposed at the base and leading into a flash hole (15), wherein the flash hole extends along a neck (38) of the casing to the distal end; or b) machining the primer retention feature and/or the flash hole; inserting a stretch rod (27) into the blind hole and stretching the neck from a first length (41) to a second length (42), the casing now in a third state (11*c*); providing a blow mold cavity (28, 29, 30); inserting the casing in the third state into the blow mold cavity; pressurizing the blind hole with an air pressure causing the neck of the casing to be blow molded into a fourth state (11*d*), wherein the neck of the casing now comprises at least one undercut (18) circumferentially disposed about the longitudinal axis of the casing; and removing at least a portion (45) of the distal end of the casing, the casing now being in a fifth state (11*e*).

While the casing is in the first state, the method may include the step of placing an insulator (23) and/or reflector (24) around at least a portion of the casing separating the base from the neck, and while using a heater (25), directly heating the neck of the casing while not directly heating the base of the casing, the casing now in a second state (11*b*).

The entirety of the casing in the fifth state may be made from the polymer, wherein the polymer is a single material.

The method of manufacturing the ammunition cartridge may utilizing the casing disclosed and may now include the step of disposing a primer (12) inside the primer retention feature, adding a propellant (14) inside the casing and disposing a projectile in the distal end of the casing.

Another exemplary embodiment of the present invention is a method of manufacturing a casing (11) for an ammunition cartridge (10). The method comprises the steps of: providing an injection mold (55, 56, 57, 58); using the injection mold, injection molding a first polymer forming a first part (52) of a casing, wherein the first part of the casing is generally cylindrically shaped (35) along a longitudinal axis (36) and includes a stepped end (54) forming a first part (53) of a mechanical connection; removing a portion (57, 58) of the injection mold exposing the stepped end of the first part of the casing; disposing an additional mold (59, 60, 61) about the stepped end of the casing; using the additional mold, injection molding a second polymer forming a second part (62) of the casing, wherein the second part includes a second stepped end (63) forming a second part (64) of the mechanical connection; wherein the first and second stepped ends are mechanically locked together; providing a thermal swagging tool (68, 69); and using the thermal swagging tool, forming a conical tapered region (70) along an end (71) of the first part of the casing opposite the mechanical connection.

The first polymer and second polymer may not be the same material type.

The second polymer may comprise ceramic or metal powder additives and the first polymer does not comprise ceramic or metal powder additives.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
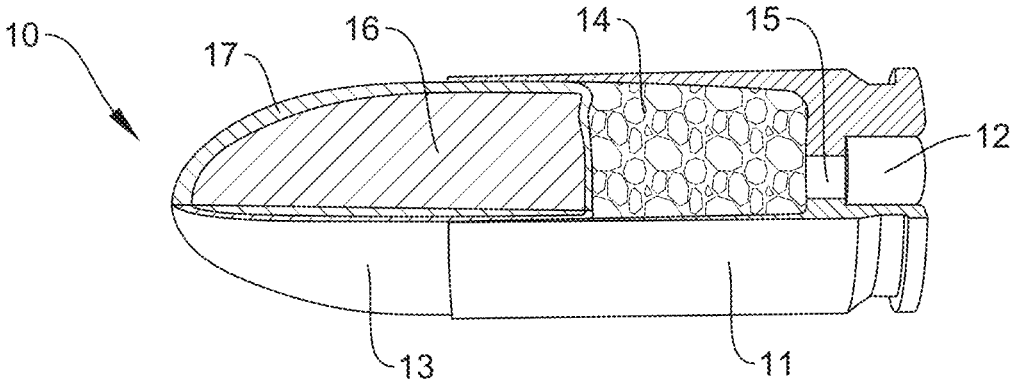
FIG. 1 is a partial cross-sectional view of a typical ammunition cartridge.

Often, people mistakenly refer to an ammunition cartridge as a bullet, yet the bullet is typically just one of four parts that form the ammunition cartridge. FIG. 1 shows the four main parts of an ammunition cartridge 10, which are the casing 11, the primer 12, the projectile 13 (i.e., the bullet) and the propellant 14 (i.e., gunpowder).

The Casing: A bullet's casing is the metal shell that encases the bullet's propellant. It is usually made of brass, although steel or aluminum casings are also used. The casing also holds the bullet's primer, which ignites the propellant and causes the bullet to be fired from the gun. When a bullet is fired, the casing is ejected from the gun along with the spent primer. The casing can then be reloaded with a new primer and propellant and reused. When the primer explodes after being struck by the firing pin, the small explosion travels through the flash hole to then ignite the propellent inside the casing.

The Primer: A primer in a bullet is a small explosive charge that serves to ignite the powder in the cartridge. It is located at the base of the cartridge and is usually made of a material that is readily ignitable by heat or friction. When the trigger of a firearm is pulled, the firing pin strikes the primer, causing it to detonate. The resulting explosion ignites the powder within the cartridge, propelling the bullet out of the barrel. In order for a primer to function properly, it must be of the correct size and type for the particular caliber of ammunition being used. Additionally, the primer must be seated correctly in order to ensure reliable ignition. Improperly seated primers can cause misfires, which can be dangerous.

The Projectile: The projectile is the part of the bullet that actually strikes the target. It is usually made of lead 16, although other materials such as steel or copper can also be used. The lead 16 may also have a metal jacket 17. The projectile is seated on top of the propellant within the cartridge. When the primer is detonated, the resulting explosion ignites the propellant and propels the projectile out of the barrel. The projectile continues to travel forward until it strikes the target or runs out of kinetic energy.

The Propellant: Gunpowder, also known as black powder, is a type of explosive that is used in bullets. It consists of a mixture of sulfur, charcoal and potassium nitrate. When gunpowder is ignited, it rapidly expands and produces a large volume of gas. This gas is what propels the bullet out of the barrel. Gunpowder is very sensitive to heat and friction, so it must be carefully handled in order to avoid accidental detonation.

Figure 2:
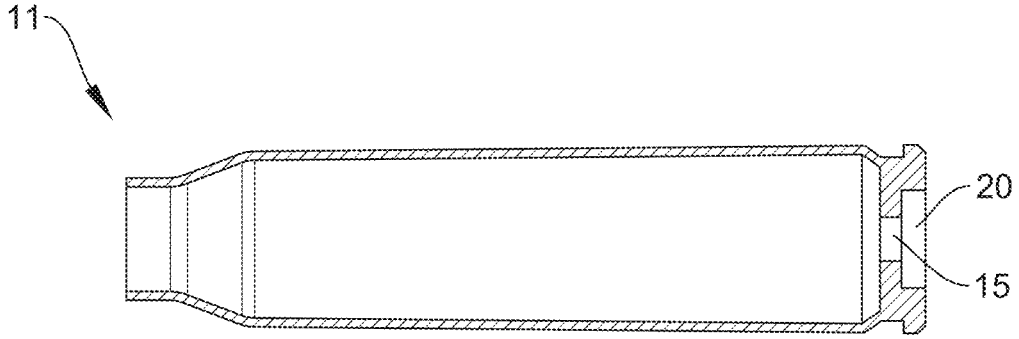
FIG. 2 is a cross-sectional view of a 7.62 mm casing.
Figure 3:
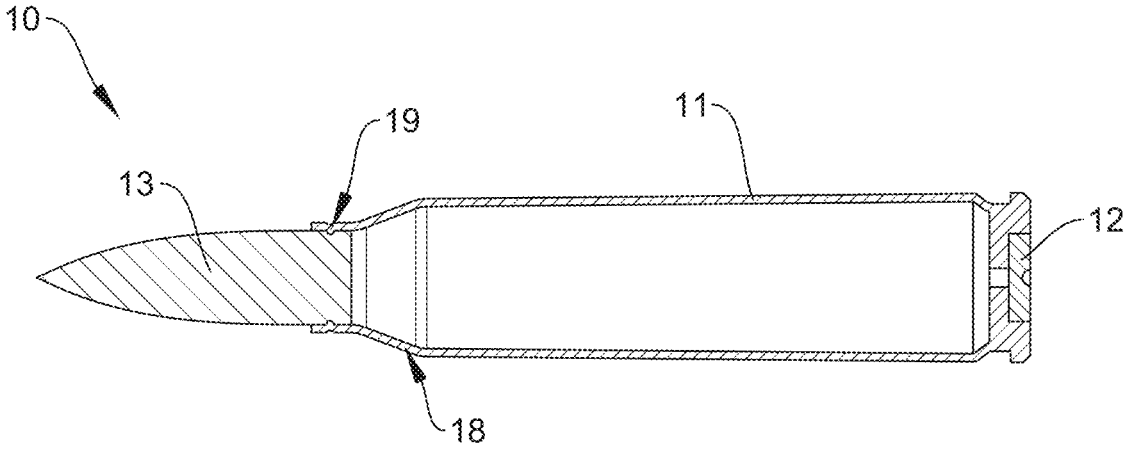
FIG. 3 is a cross-sectional view similar to FIG. 2 now with a bullet and primer cap attached.

Single Piece Polymer Ammunition Casing:

As explained earlier, the casing is typically made of metal. However, the inventors of the present application have developed a casing that is manufactured from a polymer. The invention described herein utilizes an injection-stretch blow molding process to mold severely undercut 18 regions while maintaining thin wall sections with high dimensional consistency in a single piece casing, similar to the single piece casing 11 shown in FIG. 2 which is a cross section of a 7.62 mm casing. FIG. 3 shows the casing of FIG. 2 with a bullet 13 and primer cap 12 attached but missing the propellant. A challenge for polymer-based munition casings is the requirement to use resins that can withstand the extremely high temperatures and pressure waves resulting from the firing event. The present invention disclosed herein uses a low-cost commodity resin with strength enhancing additives such as carbon nanotubes and graphene platelets.

Review of the prior art for polymer casing design and production yields more than 200 existing patents. Most of these patents ignore the difficulties of injection molding polymer munition casings with necked or severely undercut regions. Several of the patents do attempt to accommodate the necked (i.e., undercut 18) region of the casing with a two-stage operation, where the first stage molds a straight wall axisymmetric cylinder and the second stage uses a thermoforming operation to produce the reduced diameter neck. Other approaches use a multi-piece casing design to eliminate the severe undercuts. Additionally, an insert molding operation is sometimes contemplated to overmold a metallic primer insert, but this is not really a single piece ammunition casing. Neither of the approaches is suitable for high volume production of a molded component with attendant precision thin walls. Also, various schemes have been proposed to help retain the projectile to the casing with sufficient retention force, where the typical annual retaining rib feature results in yet another undercut confounding molding. Alternatives such as molding high grip texture and other similar approaches show up in the patent literature. Additionally, the use of materials in the patent filings reviewed show no specific reference to high strength additives, such as graphene platelets or carbon nanotubes.

The present invention teaches that the optimal solution for low-cost production of consumer grade polymer munitions lies with a combination of advanced material additives in a commodity base resin, combined with a high-speed manufacturing process of molding severe undercuts with precision thin walls resulting in a single, one-piece casing with consistent wall thicknesses.

Material Additives:

The mechanical requirements of the molded polymer casing are extremely challenging. High resistance to heat and pressure waves are needed at very high strain rates, and the ammunition casing must resist these forces and then successfully eject from the chamber without jamming. This is contrasted with the need for low cost which can rule out traditional polymer solutions, for example PEEK with 40% carbon fiber fill which ranges to $40/pound for raw resin.

The use of high-tech additives with commodity resin is therefore an attractive alternative. Examples would be a base resin of polypropylene, high density polyethylene, or acetal with multiwalled carbon nanotubes or graphene platelets as an additive. The use of carbon nanotubes can increase tensile strength of the base polymer by roughly 150%.

A rough weight estimate of a 7.62 sized casing (no primer cap and no projectile) molded from neat PP would be on the order of 0.86 grams to 1.0 gram. Carbon nanotubes are approximately $2-$4/gram depending on the source, with a typical let down ratio of 1% over the base resin. At $1.10/pound for virgin PP, we have the following raw material estimates: $0.02 for the base resin and $0.04 for the nanotube additive=$0.06 total for raw materials.

If another base resin such as HDPE is substituted, we might expect the cost to go higher, perhaps by another $0.02 per unit. The base resin will be chosen on which has better dispersion properties for the carbon nanotubes.

Injection Stretch Blow Molding:

Due to the severe undercuts preventing a simple open and shut injection molding cycle, some means must be considered which can accommodate the undercuts. For example, the dimensional undercut 18 on the 7.62 mm casing as shown in FIGS. 2 and 3 is too large and the open volume too small to accommodate a collapsing core pin typical of conventional injection molding applications. In addition, it has very thin side walls (0.005"-0.020" thick) which can be difficult to consistently fill when single gated from one end. Furthermore, when injection molding, it is desired to have one thickness throughout the part for consistency. Thus, the thicker end of the casing in comparison to the thinner walls makes injection molding more difficult. None of the patents reviewed discuss this difficulty, which can make molding the part infeasible due to "short shots".

Research on various manufacturing processes indicates that using injection stretch blow molding may be a breakthrough process for axisymmetric cylindrical shapes such as the 7.62 mm casing. Other than the ease of molding undercuts, an additional and significant benefit is the bi-axial orientation of the material during stretch forming. Research data shows tensile strength increasing more than 200% during the process of stretching the parison. (The term parison as used herein refers to an unshaped mass of molten material before it is molded into its final form.) Introducing the air blow additionally orients to the radial direction and increases hoop strength performance by as much as 500%.

This method has been used most typically by packaging manufacturers for plastic container production and is fairly common in the United States. The inventors can find no record of this method ever being used with carbon nanotube additives nor with regard to ammunition casings. Using this method, thin walls are also (relatively) easily maintained to nominal wall sections of 0.007"-0.010" with good consistency and the annular projectile capture features are easily molded.

Projectile Retention:

When using polymer molded casings, retention of the projectile (before firing) is an important consideration. The interface between the outer diameter (OD) of the projectile and the inner diameter (ID) of the casing constitutes a precision fit and tolerances must be held tightly. The interface between the two components provides an initial gas seal as well as a means of mechanical attachment. The fit must be tight enough to prevent any dislodging of the projectile during normal transit, handling and recoil, and not too tight as to adversely influence the firing event.

For conventional metallic (both ferrous and non-ferrous) casings, one of two retention methods are typically used: a) an interference fit; and b) a crimped interface. The interference fit relies on close tolerances between the two components, as well as a slight elastic deformation of the casing during insertion of the projectile, where the resulting hoop stress (neck tension) and frictional contact provide the necessary retention forces. The crimping process typically uses a cannelure 19 formed on the projectile and a roll crimp tool is used to plastically deform (swage) the casing into the cannelure, retaining the projectile with a positive mechanical connection. The cannelure is the groove around the cylinder of a bullet.

Primer Cap Retention:

In a similar fashion to projectile retention, a smaller pocket (i.e., the primer cap pocket 20) is molded in the casing for an interference fit with an industry standard primer cap which will be pressed into place in a counterbored recess. In addition, a gas vent (i.e., flash hole) is allowed at the bottom of the primer counterbore through into the main chamber. This is formed by a core pin in the mold. Another version may require a non-standard primer cap OD to mate with the slightly larger ID of the molded casing necessitated by the stretch pin opening.

The invention can be described as consisting of several key attributes:

1. One-piece molded construction of the polymer casing is obtained using the injection stretch blow molding process.
2. The one-piece design and associated process accommodates severe undercuts and molded-in annual ribs for cannelure engagement. (a) The resulting mechanical attachment of the projectile reduces the effects of visco-elastic behavior acting on the projectile. (b) Also, consistency of the projectile pull-out forces is obtained.
3. The use of low-cost commodity type polymer base resins reduces manufacturing costs, polymers such as: polypropylene; polyethylene; acetal; nylon; ABS; PET; polyamides; PEEK; general co-polymers; general homo-polymers; fiberglass filled materials; and/or Talc filled materials.
4. The use of high-performance additives for the base resin enhances thermal and structural performance. (a) Carbon multi-walled nanotubes can be used for the purpose of increasing mechanical strength in the various deformation modes experienced during the firing event. A range of let-down ratios from 0.01% to 30% are claimed. (b) Graphene platelets increase thermal conductivity and heat transfer during the firing event. A range of let-down ratios from 0.01% to 30% are taught herein. The let-down ratio refers to the percentage by weight of additive to base resin in the final composition.
5. Significant increase in mechanical properties of the polymer materials are due to: (a) axial polymer chain orientation during the stretch portion of the parison during injection stretch blow molding; (b) additional radial orientation of the polymer chains during the subsequent blow portion of the molding operation; and (c) orientation increases the contributions of high strength additives such as carbon nanotubes and graphene platelets.
6. High speed/low-cost production of the molding operation using unique manufacturing operations is realized. (a) Application specific cutoff operation is accomplished after the blow process is complete, establishing with precision the overall length of the casing. (b) High precision thin walls with dimensional stability over the length of the casing are realized. (c) The net shape of the projectile interface surfaces are realized. (d) The net shape of the primer receiving cup are realized. (e) The net shape of diameter and overall length are realized with no secondary operations required.

List of Calibers

The '318 provisional application listed the caliber and munition types that are claimed under this concept for rifle cartridges and also listed the caliber and munition types for piston cartridges. Accordingly, the present invention can be applied to any casing.

Manufacturing Process:

The '318 provisional application showed and taught the basics of a generalized injection stretch blow molding process predominantly used to manufacture thin-walled containers. The process of the present invention differs in several ways as will now be explained in more detail.

Figure 4:
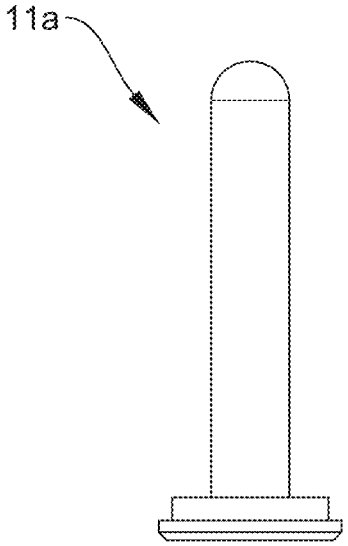
FIG. 4 is a side view of a casing in a first manufactured state after being injection molded as part of a new embodiment of manufacturing a single piece polymer casing.
Figure 5:
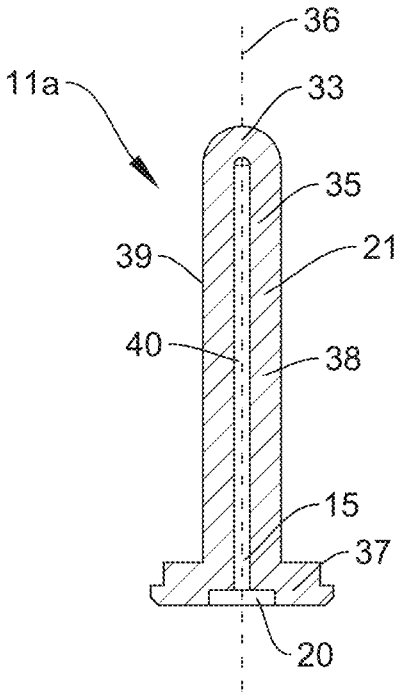
FIG. 5 is a sectional view of the structure of FIG. 4.

FIG. 4 shows a casing 11*a* that has been injection molded in a first state. FIG. 5 is a sectional view of the casing of FIG. 4. The primer retention feature 20 and flash hole 15 are formed at this time during the injection molding process and shown in FIG. 6. In FIG. 5, one can see that the neck 21 is relatively short and thick in comparison to the finished casing as shown in FIG. 2.

Alternatively, the casing 11*a* could be molded without the primer retention feature and flash hole. The casing 11*a* would be very thick absent the blind hole disposed therein. Then, in a machining step, the primer retention feature and flash hole could be precision machined.

Figure 6:
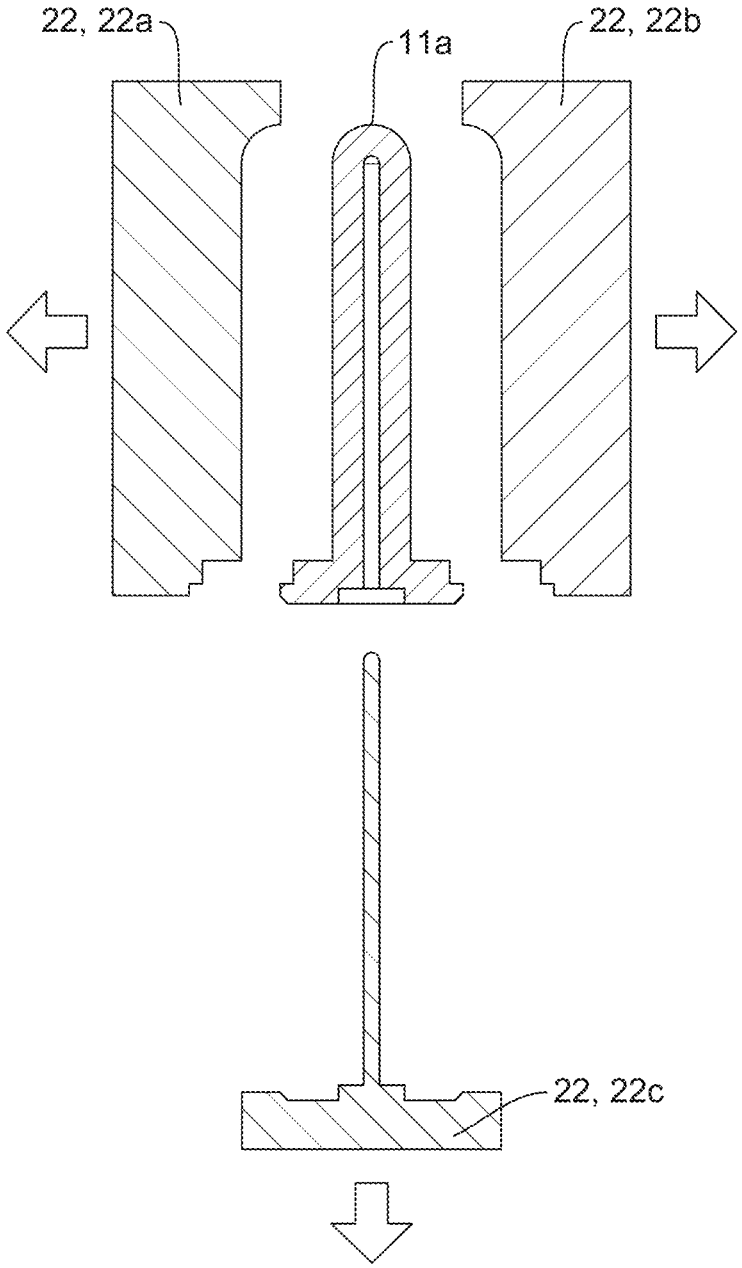
FIG. 6 is a side sectional view of an injection molding operation for the structure of FIGS. 4 and 5.

FIG. 6 shows just one possible molding structure used to manufacture casing 11. There can be a left mold 22*a* and a right mold 22*b* that separate respectively to the left and right. There can also be a lower mold 22*c* (i.e., a pull mold) that separates and moves downward. As shown in FIG. 6, the casing is oriented with the necked region facing upward but could have been oriented with the necked region facing downward. This embodiment is just one simplified version of how the casing 11*a* can be injection molded and is not to be limited to this exact method.

Figure 7:
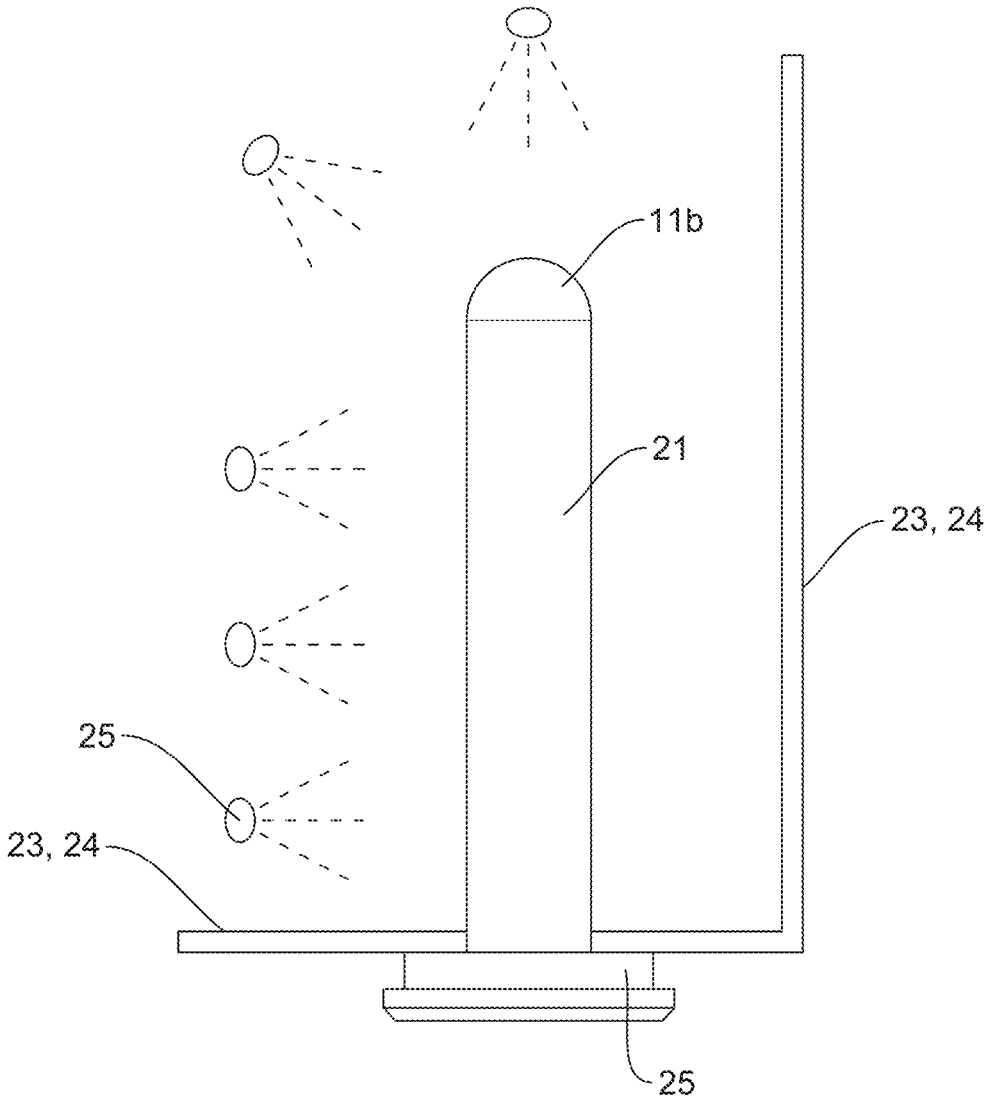
FIG. 7 is a side view of an optional heating step to raise the temperature of the casing to a second state.

FIG. 7 shows that the casing 11*a* can optionally be heated with infrared heaters 25, hot air or the like to raise the temperature of the neck 21 such that the casing is now in a heated state of casing 11*b*. An insulator 23 and/or reflective pad 24 (i.e., reflector) may be used to shield and protect the bottom 25 of the casing 11*a* while allowing the neck 21 to be heated.

Figure 8:
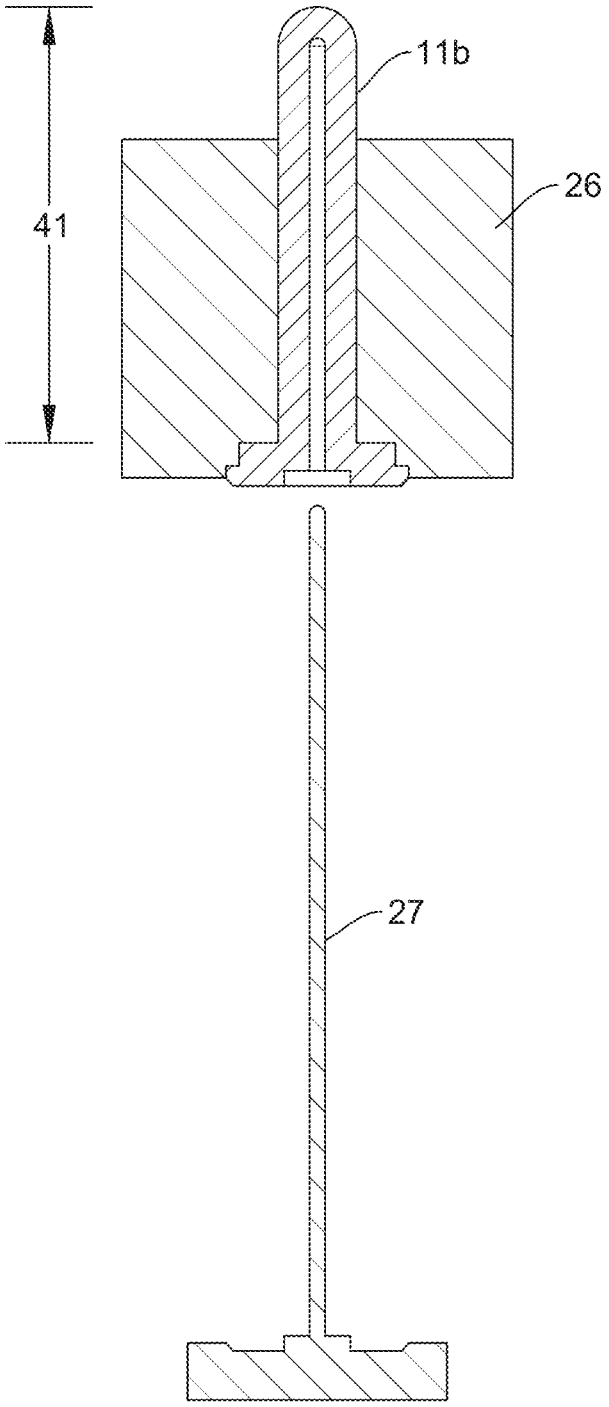
FIG. 8 is a side sectional view of the heated casing in the second state about to be lengthened along its neck region.

FIG. 8 shows the next step in the method, where the casing 11*b* is being held in a tool 26 while still being in the heated state from FIG. 7. Then, a stretch rod 27 is about to be inserted.

Figure 9:
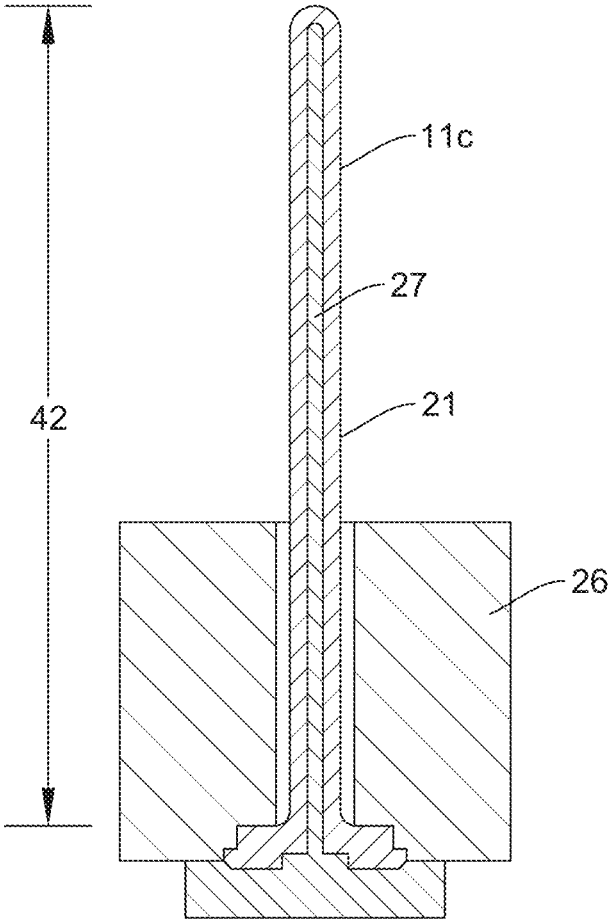
FIG. 9 is similar to FIG. 8 now showing the casing in a third state where the neck has been stretched.

FIG. 9 shows the stretch rod 27 inserted and lengthening the neck 21. The neck 21 is now longer while thinner in comparison to it in FIG. 8. The casing is now casing 11*c* as it has been stretched. This step orients the polymer chains along the axial direction.

Figure 10:
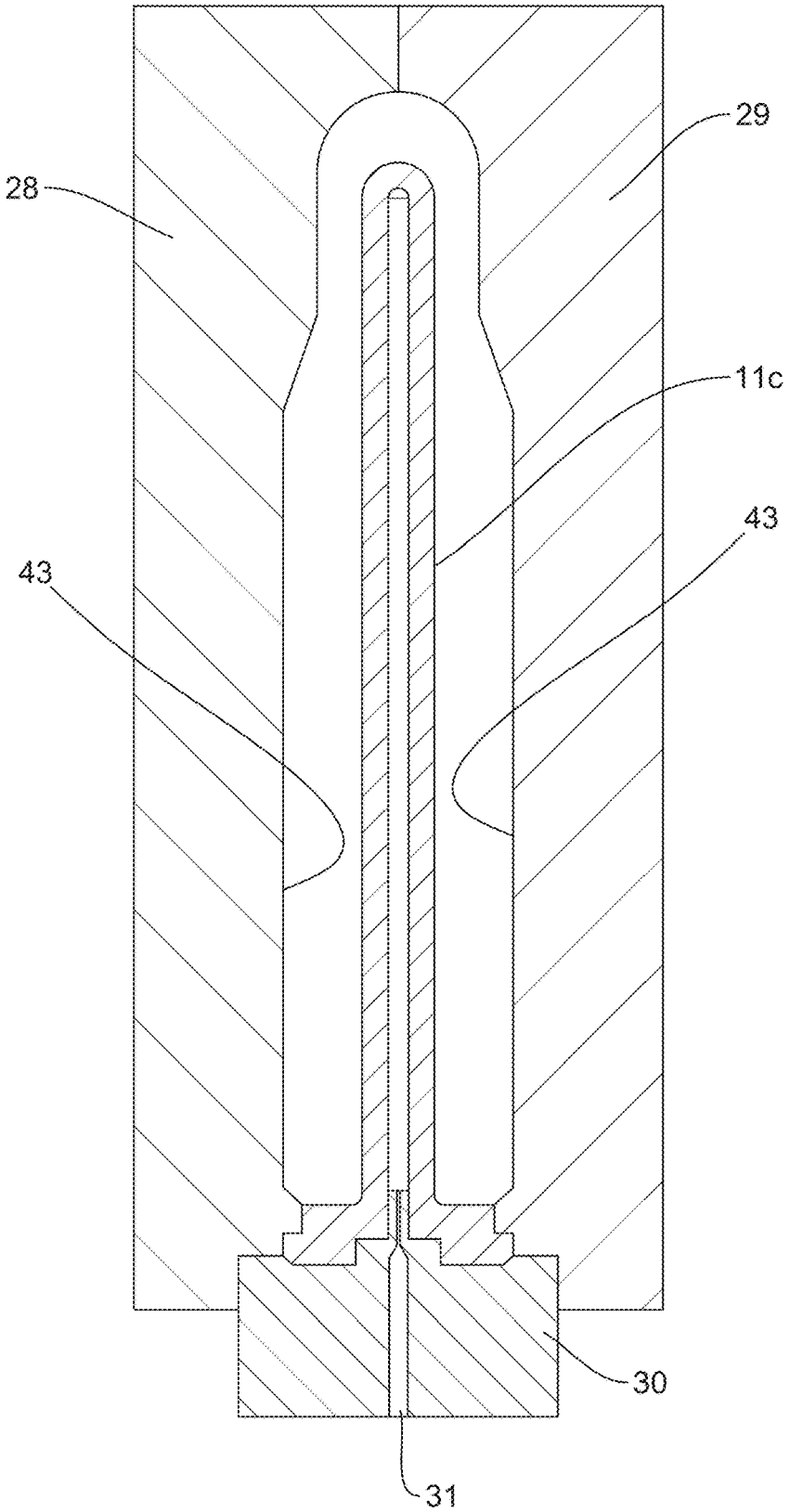
FIG. 10 is a side sectional view of the casing in the third state placed inside a blow molding operation.

FIG. 10 shows another left tool 28 and a right tool 29 that have the shape of the casing wall in a finished state. Another tool 30 is inserted from below that has a pressurized hole 31 that can introduce pressurized air into the blind hole of the casing 11*c*. Keep in mind that the neck 21 is still in a heated state, so it can be expanded. The injection molded casing may be inserted into the blow mold cavity while still preheated to a temperature range of 100° F. to 500° F. The blow mold cavity may also be preheated to a temperature of 60° F. to 212° F.

Figure 11:
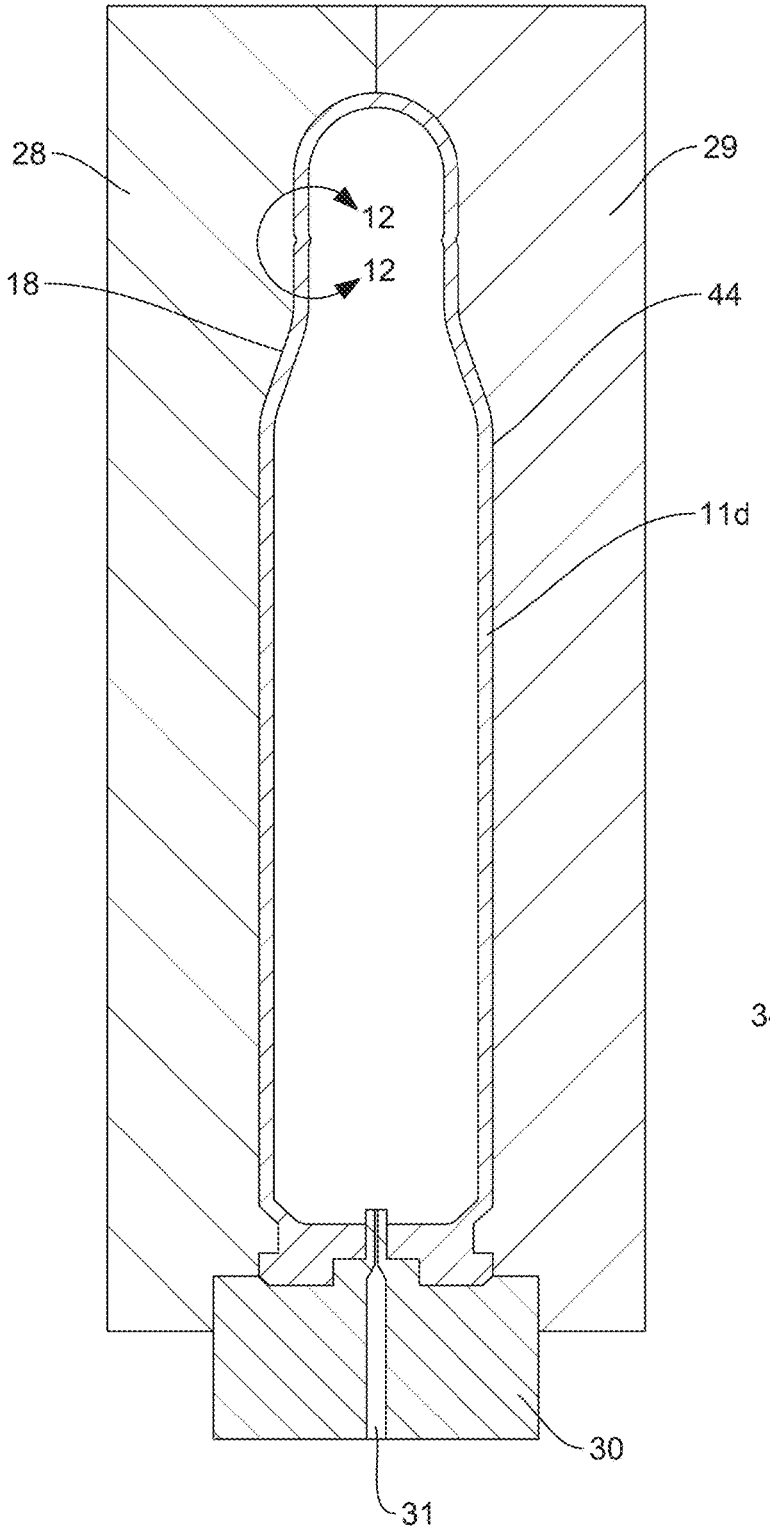
FIG. 11 is similar to FIG. 11 now showing the casing in a fourth state that is expanded to conform to the inner walls of the blow mold.

FIG. 11 shows pressurized air being entered into the blind hole and then forcing the walls of the casing to expand to the walls of the molds 28 and 29. In this step the polymer chains are additionally oriented in the radial direction. As compressed air is injected into the stretch pin, inflating the heat softened partition to expand now radially into contact with the cooler walls of the steel cavity. Upon contact with the tooling surfaces, the material cools and conforms to the shape defined by the female cavity including the undercuts. Optionally, the mold can include an annular rib feature 34 for the cannelure 19 such that it is formed at this time. The casing is now casing 11*d*.

Figure 12:
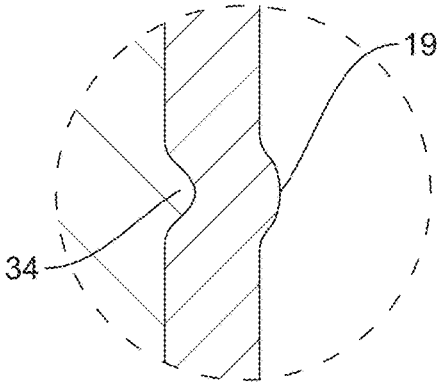
FIG. 12 is an enlarged taken along lines 12-12 from FIG. 11.
Figure 13:
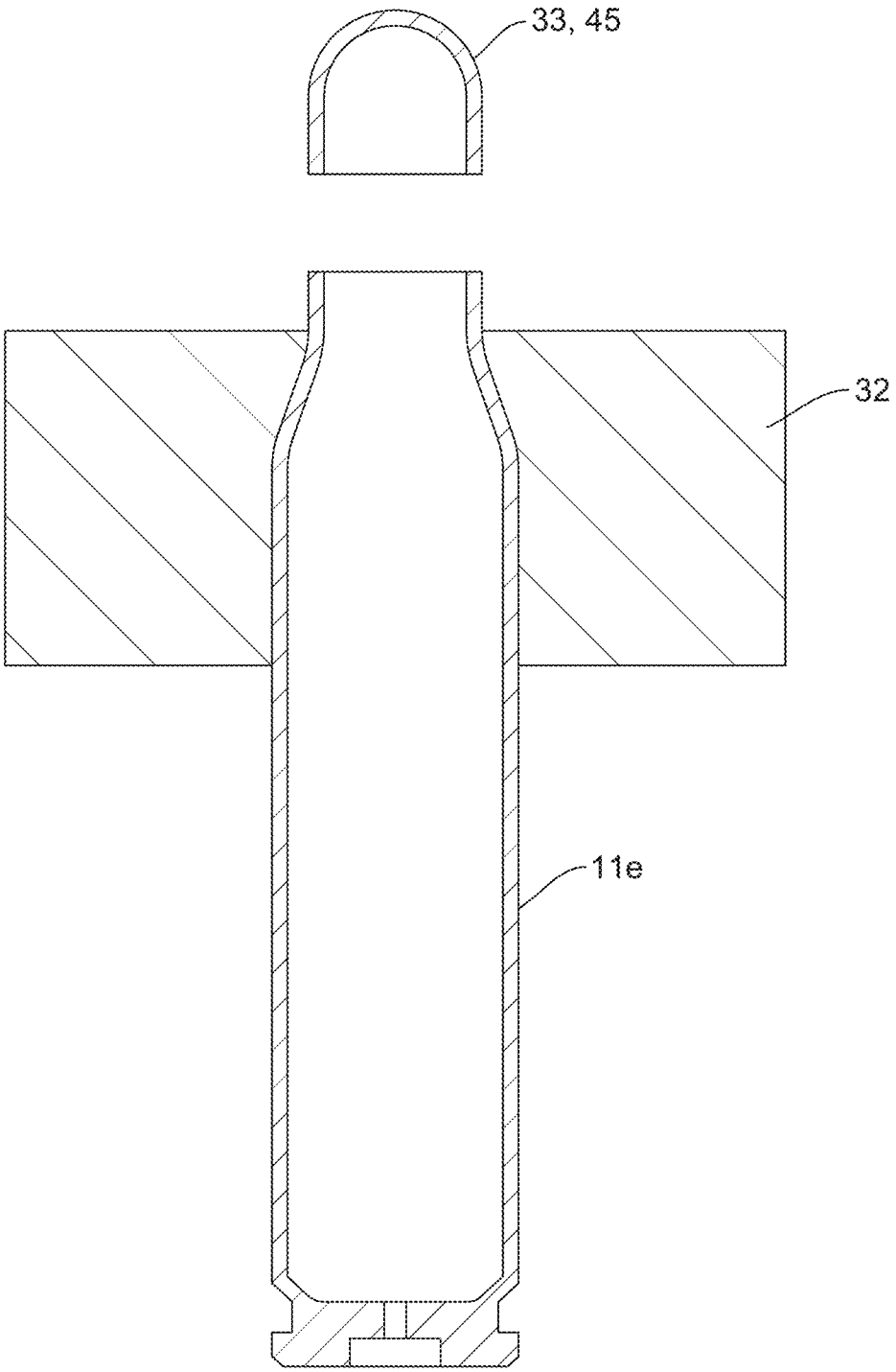
FIG. 13 is a side sectional view of the casing in a fifth state where its tip has been trimmed off to its desired and final length.

FIG. 12 shows the cooled casing being placed into an additional tool 32. Then, the end 33 of the casing can be cut, machined or sliced off. As the stretching process leaves extra length beyond the finished end of the part, this trimming operation can be performed while still in the previous mold or a new mold to establish the finished length. The casing 11*e* is then in the final state as shown in FIG. 2.

All of the steps described herein can be performed with robotic tooling such that the casing moves quickly from each stage without the need for human handling. This speeds production time while keeping the hot parts of the casing hot as needed during the stretching and blow molding stages.

Key Attributes:

The injection stretch blow molding process inherently supports many different kinds of projectile crimp configurations that can be difficult or impossible to achieve with conventional polymer injection molding, such as cannelure crimping, taper crimping and/or roll crimping.

Casing shapes and rim configurations supported by the invention include: necked down of "bottle shaped" designs; straight wall, cylindrical casings; tapered casing designs; belted rim designs; semi-rimmed designs; rim designs; rimless designs; and/or rebated designs.

Molding of an annular internal rib integral with the casing to mate with a typical projectile cannelure, providing positive mechanical retention between the two components, reducing the effects of visco-elastic behavior (creep).

One piece molding of a typical "bottle shaped" cartridge casing. One piece manufacturing as taught above results in a single piece polymer ammunition casing, meaning the material is the same material throughout and is free from fasteners, adhesives, bonds and the like. It means the material is continuous and uninterrupted with breaks, cuts or assembly joints.

Two-Shot Molded Polymer Ammunition Casing:

The invention described herein now teaches a two-shot injection molding process to mold a single piece casing utilizing two entirely different materials. A low-cost commodity resin with high performance additives may be used for the shoulder walls of the casing. Then, a second material may be co-molded in a two-shot molding machine that contains a high-performance engineering resin with either ceramic or metal powder additives to increase localized thermal performance to result in a single piece casing.

A singular challenge for polymer-based munition casings is the requirement to use resins that can withstand the extremely high temperatures and pressure waves resulting from the firing event. The ceramic/metal matrix second shot provides this performance. Review of prior art for polymer casing design and production yields more than 200 existing patents. Most of these patents ignore the difficulties of injection molding polymer munition casings with necked, or severely undercut regions. Several of the patents do attempt to accommodate the necked (undercut) region of the 7.62 mm casing with a two-stage operation, the first stage molds. A straight wall axisymmetric cylinder, the second stage uses a thermoforming operation to produce the reduced diameter neck. Other approaches use a multi-piece casing design to eliminate the severe undercuts.

Also, various schemes have been proposed to help retain the projectile to the casing with sufficient retention force, the typical annual retaining rib feature results in yet another undercut confounding molding. Alternatives such as molding high grip texture and other similar approaches show up in the patent literature. Additionally, the use of materials in the patent filings reviewed show no specific reference to high strength additives, such as graphene platelets or carbon nanotubes. The optimal solution for low-cost production of consumer grade polymer munitions lies with a combination of advanced material additives in a commodity base resin, combined with a high-speed manufacturing process of molding severe undercuts with precision thin walls resulting in a single, one-piece casing with consistent wall thicknesses.

Material Additives:

The mechanical requirements of the molded polymer casing are extremely challenging. High resistance to heat and pressure waves are needed at very high strain rates, and the ammunition casing must resist these forces and then successfully eject from the chamber without jamming. This is contrasted with the need for low cost which can rule out traditional polymer solutions, for example PEEK with 40% carbon fiber fill which ranges to $40/pound for raw resin.

In this embodiment this is solved using two separate materials, the low-cost commodity resin with carbon additives for the main casing and a high-performance ceramic metal/matrix material that molds the much smaller primer end of the casing, where most of the force and thermal effects are concentrated.

A rough weight estimate of a 7.62 mm sized casing (no primer cap and no projectile) molded from neat PP would be on the order of 0.86 gram to 1.0 gram. Carbon nanotubes are approximately $2-$4/gram depending on the source, with a typical let down ratio of 1% over the base resin. At $1.10/pound for virgin PP, we have the following raw material estimates: $0.02 for the base resin and $0.04 for the nanotube additive=$0.06 total for raw materials.

The cost for the ceramic/metal matrix polymer is much higher, however the amount of resin used is quite small as the total approximate volume is less than the main casing. The total approximate volume of the 7.62 mm cartridge casing is about 1049 $mm^3$, while the primer region using the ceramic metal matrix is about ¼ the total volume, or about 237 $mm^3$.

Two Shot Injection Molding:

Accommodation of the high thermal conditions and high frequency shock loads are managed in a manufacturing process that combines the two discrete materials into a singular monolithic molding. There are at least two methods to accomplish two-shot molding; (a) using a two barrel/two screw molding press with each barrel dedicated to a specific material, the press machinery then rotates the mold 180 degrees to result in two entirely separate but simultaneous molding operations in the same machine; or (b) using two separate molds and two separate molding machines, and manually transferring the molded part from the first stage to the second.

Projectile Retention:

When using polymer molded casings, retention of the projectile is an important consideration. The interface between the OD of the projectile and the ID of the casing constitutes a precision fit, and tolerances must be held tightly. The interface between the two components provides an initial gas seal as well as a means of mechanical attachment. The fit must be tight enough to prevent any dislodging of the projectile during normal transit, handling, and recoil, and not too tight as to adversely influence the firing event.

For conventional metallic (both ferrous and non-ferrous) casings, one of two retention methods are typically used: (a) interference fit; and (b) a crimped interface. The interference fit relies on close tolerances between the two components, as well as a slight elastic deformation of the casing during insertion of the projectile. The resulting hoop stress (neck tension) and frictional contact provide the necessary retention forces. The crimping process typically uses a cannelure formed on the projectile, and a roll crimp tool is used to plastically deform (swage) the casing into the cannelure, retaining the projectile with a positive mechanical connection.

Primer Cap Retention:

In a similar fashion to the projectile retention, a smaller pocket is molded for an interference fit with an industry standard primer cap which will be pressed into place in a counterbored recess. In addition, a gas vent is allowed at the bottom of the primer counterbore through into the main chamber. This is formed by a core pin in the mold.

Prior Art

Review of these patents and associated claims leads to some common limitations. All are multi-piece casing designs due to the inherent difficulties in traditional injection molding. This requires some non-trivial means of attachment between the various pieces. Metal Injection Molding (MIM) is claimed with the same considerations and limitations as above. Many polymer base resins are claimed but no reference to carbon nanotube additives or graphene platelet additives was found. Alternative projectile retention mechanisms are claimed, typically using molded in surface textures to increase surface friction. No mention can be found accommodating the inherent visco-elastic behavior of polymers under long term tension load, such as stress relaxation or creep. These phenomena conspire to the effect of loosening the projectile fit to the polymer casing over time.

The invention can be described as consisting of several key attributes:

1. One-piece molded construction of the polymer casing, using the two-shot injection molding process.
2. The one-piece injection molded design does not accommodate the undercut region fixing the projectile. This region is formed with straight cylindrical walls, and subsequent thermal swaging imparts the conical taperer region that clamps the projectile.
3. The use of low-cost commodity type polymer base resins to reduce manufacturing costs, such as: polypropylene; polyethylene; acetal; nylon; ABS; PET; polyamides; PEEK; general co-polymers; general homopolymers; fiberglass filled materials; and/or talc filled materials.
4. The use of high-performance additives for the base resin to enhance thermal and structural performance. (a) Carbon multi-walled nanotubes for the purpose of increasing mechanical strength in the various deformation modes experienced during the firing event. A range of let-down ratios from 0.01% to 30% are claimed. (b) Graphene platelets to increase thermal conductivity and heat transfer during the firing event. A range of let-down ratios from 0.01% to 30% are claimed. (c) The second shot contains polymer material suited for high temperatures and large percussive forces. These materials will be selected through test and experimentation, but under direct consideration are: (i) Ceramic/metal matrix composite polymers. (ii) "High mass" polymer compounds with metal grains added. (iii) Polymers with large carbon additives.
5. High-speed/low-cost production of the molding operation using unique manufacturing operations: (a) Two-shot molding allowing performance specific materials to be applied to different zones of the cartridge casing. (b) High precision thin walls with dimensional stability over the length of the casing. (c) Net shape of the primer receiving cup.

Manufacturing Process, Molding:

The present invention can be manufactured in a generalized two-shot injection molding process. The final casing merges two disparate polymers with different material properties into a single component in a simultaneous molding process. Every mold cycle may fill each of the cavities with the respective material where cavity one is always empty and a new part is molded of the commodity resin, and simultaneously, cavity 2 over-molds this substrate with the ceramic/metal matrix material. For example, the cavity 1 position may molded with material 1. This side of the molding press has a dedicated screw barrel for material 1, which is the substrate or main cavity casing. The cavity 2 position may rotate 180 degrees and places the now complete cavity 1 molded component under the screw barrel for cavity 2. This contains a dedicated screw barrel with the ceramic/metal matrix polymer. The shot then over-molds the substrate casing and produces a semi-finished part. The completed two-part molding then constitutes a single component which is ejected into a collection hopper for post processing.

Post Processing:

The completed molding may then be loaded into a vibratory bowl feeder and fed into a projectile assembly station, which is designed to insert and swage the projectile into the co-molded casing. The rotary assembly station is organized into two main functions; first fixturing the model component in a rotating fixture nest, then using an induction heater to soften the plastic, swaging the neck down to the final tapered size while imparting the annual containment rib to capture the projectile, then pressing the projectile into the necked down diameter for permanent retention established when the casing cools down.

Design Variations Covered Under this Invention:

Some materials do not fuse together well, mainly due to large differences in the melt front temperatures, in these cases mechanical interlocks are added to insure a tight bond between the two shots.

Key Attributes:

Cartridge shapes and rim configurations supported by the invention include: necked down of "bottle shaped" designs;

straight wall, cylindrical cartridges; tapered cartridge designs; belted rim designs; semi-rimmed designs; rim designs; rimless designs; and/or rebated designs.

Thermoforming of an annular internal rib integral with the casing to mate with a typical projectile cannelure, providing positive mechanical retention between the two components, reducing the effects of visco-elastic behavior (creep).

One piece molding of a typical "bottle shaped" cartridge casing, intermingling materials with high thermal performance with low-cost commodity resins for the main casing.

One Embodiment of a Manufacturing Process, Molding

Figure 14:
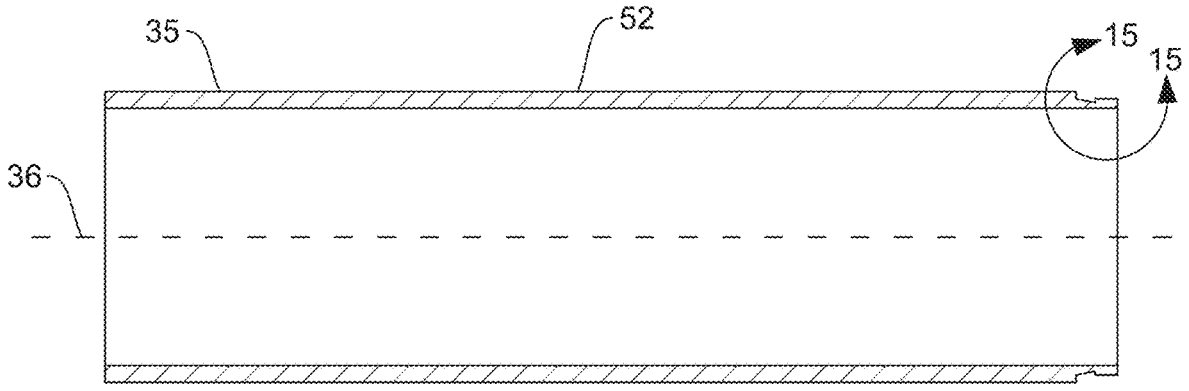
FIG. 14 is a sectional view of a partial casing manufactured in a first step of a new embodiment of a two-shot molded polymer casing.
Figure 15:
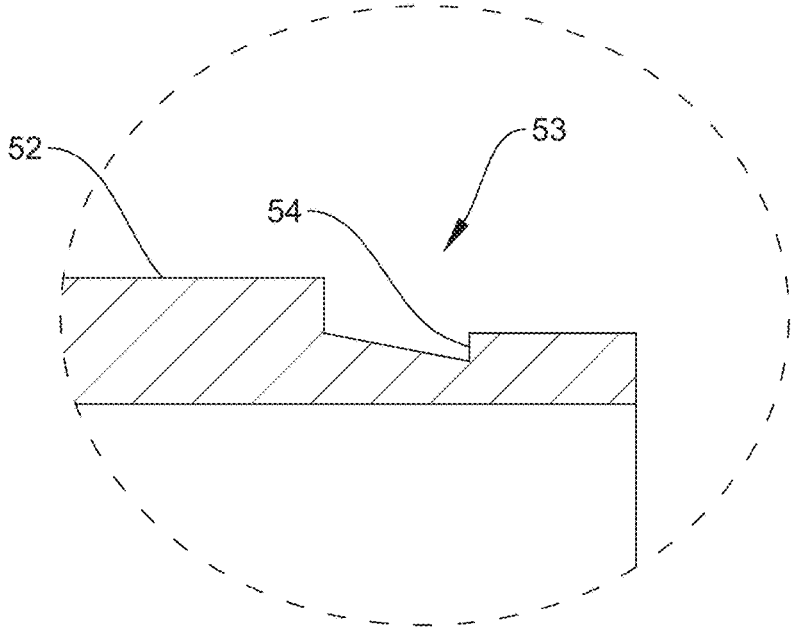
FIG. 15 is an enlarged view taken along lines 15-15 from FIG. 14.
Figure 19:
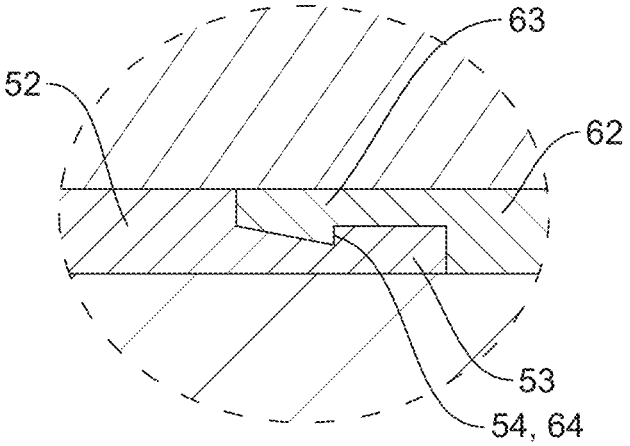
FIG. 19 is an enlarged view taken along lines 19-19 from FIG. 18.
Figure 20:
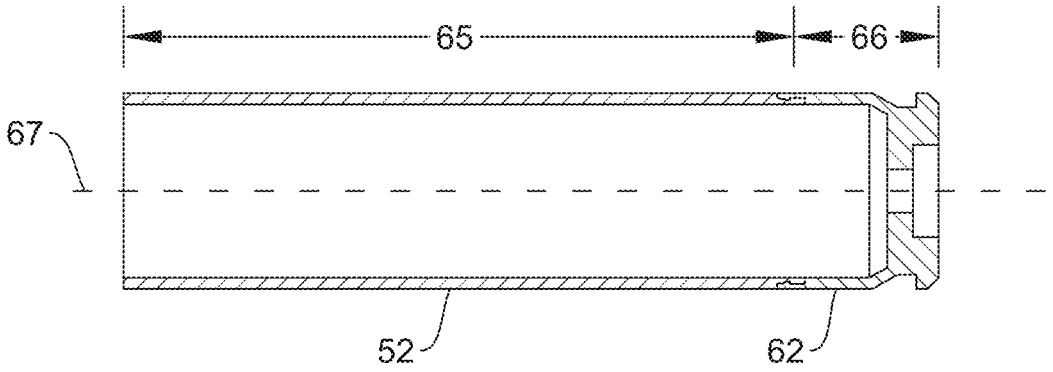
FIG. 20 shows a sectional view of the casing removed from the molds of FIG. 19.
Figure 21:
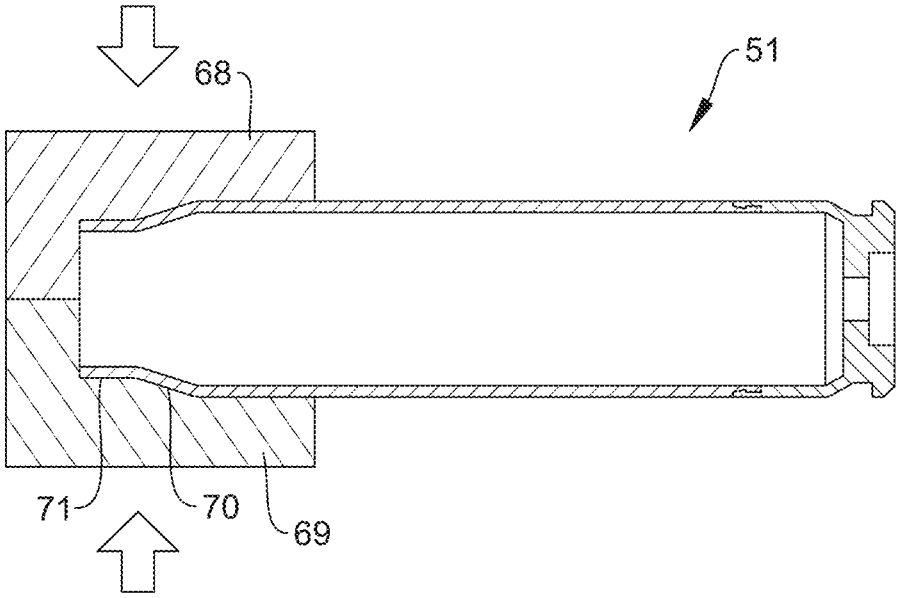
FIG. 21 shows how the distal end of the casing is thermoformed in the final manufacturing step.

FIGS. 14-21 show just one embodiment of how the present invention may be manufactured resulting in a one-piece molded construction of the polymer casing 51 shown in FIG. 21 using the two-shot injection molding process. FIG. 14 shows separately the first part 52 of the casing 51. FIG. 15 is an enlarged view taken along lines 15-15 of FIG. 14. FIG. 15 shows in greater detail how the end of the first part has a mechanical connection 53 formed therein. The mechanical connection 53 has a perpendicular stepped end 54 that faces towards the rest of the first part.

Figure 16:
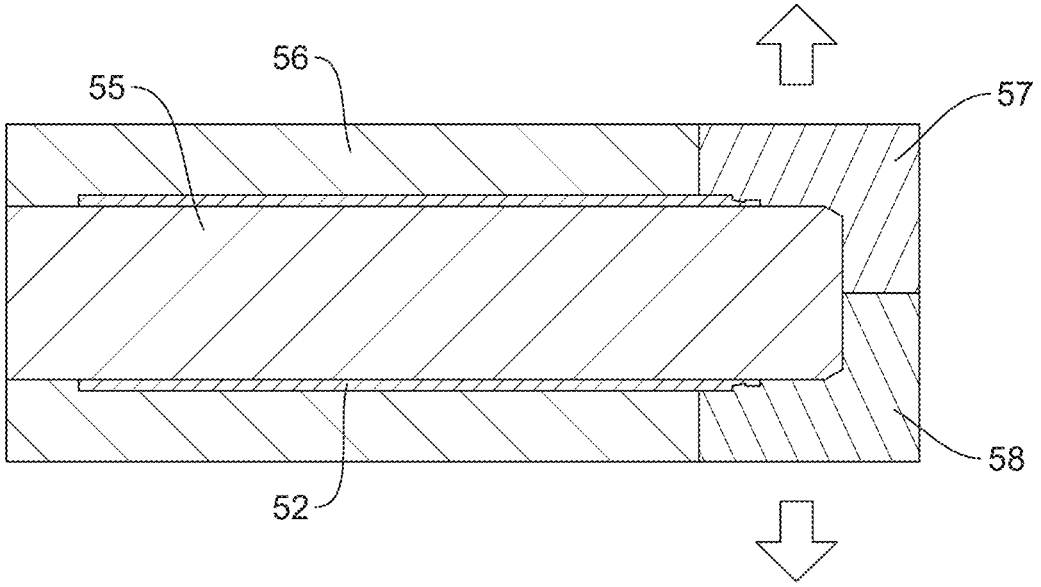
FIG. 16 shows how the structure of FIG. 14 was molded in a two-part mold that can be removed while another portion of the mold remains.
Figure 17:
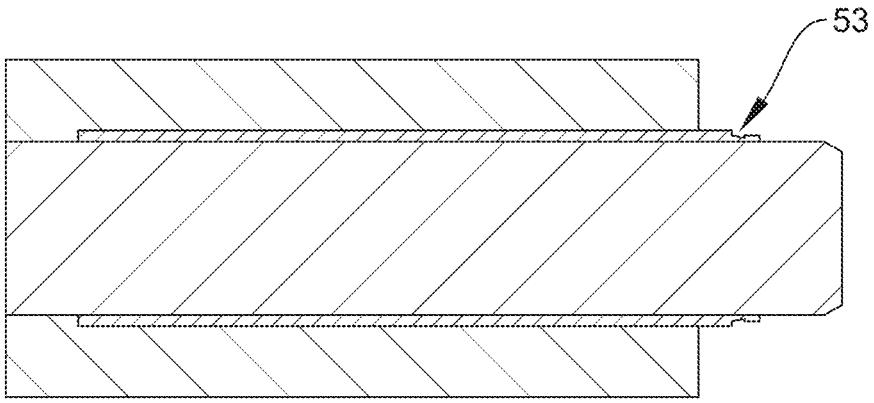
FIG. 17 shows the structure of FIG. 16 where the two-part mold was removed.

FIG. 16 shows one embodiment of how the structure shown in FIGS. 14-15 could be made. There is an inner pull mold 55 that can be removed at a later time but can be used for both processes of the two-part molding operation. There is also a first outer mold 56 that likewise is used during both processes of the two-part molding operation. A removable mold one 57 is disposed above and a removable mold two 58 is disposed below. These removable molds are pulled away in the direction of the arrows to expose the molded material there below. This then results in FIG. 17 which shows the mechanical connection 53 being exposed.

Figure 18:
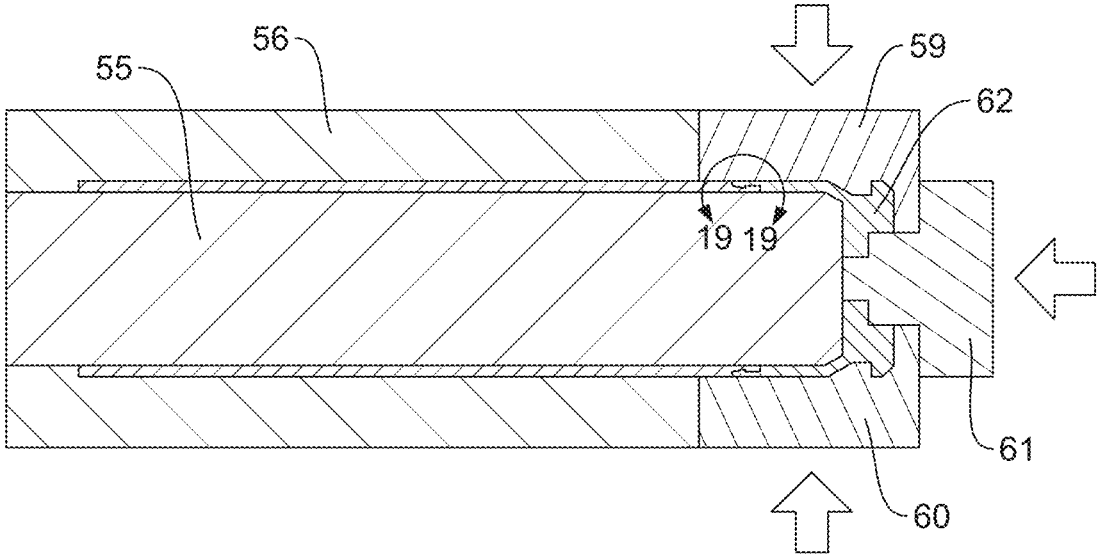
FIG. 18 shows the structure of FIG. 17 where now a different two-part mold and a pull have been placed for the second shot of the two-shot molding process.

FIG. 18 then shows that a removable mold three 59, removable mold four 60 and an inner pull mold five 61 can be attached to the pre-existing molds 56 and 57 such that now a second part 62 of the casing can be molded. FIG. 19 is an enlarged view taken along lines 19-19 of FIG. 18. The second mechanical connection 63 is formed that is oppositely matched to the first mechanical connection 53. In this manner, a stepped end 64 is formed as part of the second part that faces towards the second part. This means the stepped end 54 and stepped end 64 abut one another and form a permanent mechanical connection between the parts. Furthermore, the molding operation helps fuse the two differing materials together to some degree, further enhancing the connection. This teaching shows but one example of a typical mechanical interlock molded into the two components. There are many variations of this basic concept that will be understood by those skilled in the art and this teaching is not to be limited to the precise form shown and described herein.

FIG. 20 shows the resulting casing part from the two-stage molding operation of FIG. 18. Distance 65 is generally the distance along the longitudinal axis 67 of the first part 52. Distance 66 is generally the distance along the longitudinal axis 67 of the second part 62. The design intent is to examine different relative component lengths to arrive at the most desirable and effective distribution of the different materials. FIG. 20 shows that the split line for the intersection of the two components is intended to vary as determined by testing. The boundaries of each distance are determined by the minimum amount of high-performance ceramic/metal matrix polymer necessary to withstand the firing forces. The minimum distance 66 is about 5 mm from the primer end to a maximum of about ⅔rds the casing overall length (i.e., ⅔rds of 65+66).

FIG. 21 shows the final step where a thermal swaging tool 68 and 69 clamps and imparts along the end 71 of the casing the conical tapered region 70. The thermal swaging tool itself may be heated, or thermal heaters may be used alone or in combination to affect the tapered end of the casing.

Although several embodiments have been described in detail for purposes of illustration, various modifications may be made to each without departing from the scope and spirit of the invention. Accordingly, the invention is not to be limited, except as by the appended claims.

NUMERALS

10 ammunition cartridge
11 casing
11*a* first state, casing
11*b* second state, casing
11*c* third state, casing
11*d* fourth state, casing
11*e* fifth state, casing
12 primer
13 projectile
14 propellant
15 flash hole
16 lead
17 metal jacket
18 undercut
19 cannelure, i.e., annular rib
20 primer retention feature
21 neck, casing
22*a* left mold
22*b* right mold
22*c* lower mold
23 insulator
24 reflective pad
25 bottom, casing
26 tool
27 stretch rod
28 left tool
29 right tool
30 tool
31 pressurized hole
32 additional tool
33 distal end, casing
34 rib feature, cannelure
35 cylindrically shaped
36 longitudinal axis
37 base, casing
38 neck, casing
39 outside surface, casing
40 inside surface, casing
41 first length, neck, casing
42 second length, neck, casing
43 inside surface, blow molds
44 outside surface, casing, fourth state
45 portion of distal end, casing
51 casing, two-shot injection molded
52 first part, casing
53 mechanical connection
54 first annular face, stepped end, first part, casing
55 inner pull mold
56 first outer mold
57 removable mold one
58 removable mold two

59 removable mold three
60 removable mold four
61 inner pull mold five
62 second part, casing
63 second mechanical connection
64 second annular face, stepped end, second part, casing
65 distance, first part
66 distance, second part
67 longitudinal axis
68 thermal swaging tool
69 thermal swaging tool
70 conical tapered region, casing
71 end of casing

What is claimed is:

1. A method of manufacturing a casing for an ammunition cartridge, the method comprising the steps of:

providing an injection mold;

utilizing the injection mold, injection molding a first polymer forming a first part of the casing, wherein the first part of the casing is generally cylindrically shaped along a longitudinal axis extending from a projectile end opposite a stepped end, the stepped end forming a first end of a mechanical connection;

removing at least a portion of the injection mold exposing the stepped end of the first end of the first part;

disposing an additional injection mold about the stepped end of the first end of the first part;

utilizing the additional injection mold, injection molding a second polymer forming a second part of the casing, wherein the second part includes a second stepped end forming a second end of the mechanical connection;

wherein the first end and the second end are mechanically locked together preventing a separation of the first part from the second part;

providing a thermal swagging tool; and utilizing the thermal swagging tool, forming a conical tapered region along the projectile end of the first part.

2. The method of claim 1, wherein the stepped end of the first part includes a first annular face disposed perpendicular to the longitudinal axis and open facing towards the projectile end.

3. The method of claim 2, wherein the second stepped end of the second part includes a second annular face disposed perpendicular to the longitudinal axis and open facing away from the projectile end.

4. The method of claim 3, wherein the first annular face is in direct contact with the second annular face forming the mechanical connection.

5. The method of claim 1, wherein the first polymer and the second polymer are not the same material type.

6. The method of claim 1, wherein the second polymer comprises ceramic or metal powder additives and the first polymer does not comprise ceramic or metal powder additives.

7. The method of claim 6, wherein the first and the second polymers are the same material type.

8. The method of claim 6, wherein the first polymer and the second polymer are not the same material type.

9. The method of claim 1, wherein the injection molding of the second polymer forming the second part includes forming a casing base disposed opposite the second stepped end of the second end.

10. The method of claim 9, wherein the injection molding of the casing base includes forming a primer retention feature and a flash hole leading to an inside of the casing.

11. The method of claim 9, wherein a primer retention feature and a flash hole leading to an inside of the casing are machined after the injection molding of the second polymer forming the second part.

12. The method of claim 1, wherein the second polymer comprises a base resin of polypropylene, polyethylene, high density polyethylene and/or acetal.

13. The method of claim 12, wherein the second polymer comprises an additive of carbon nanotubes and graphene platelets in a percentage by weight of 0.01 to 30.0 percent.

14. The method of claim 1, wherein the second polymer comprises a base resin of nylon, ABS, PET, polyamides, PEEK, general co-polymers, general homo-polymers.

15. The method of claim 14, wherein second the polymer comprises an additive of fiberglass filled materials and/or Talc filled materials.

16. The method of claim 1, wherein the second polymer does not comprise PEEK.

17. A method of manufacturing the ammunition cartridge utilizing the casing of claim 10, now including the step of disposing a primer inside the primer retention feature, adding a propellant inside the casing and disposing a projectile in the projectile end of the casing.

18. A method of manufacturing the ammunition cartridge utilizing the casing of claim 11, now including the step of disposing a primer inside the primer retention feature, adding a propellant inside the casing and disposing a projectile in the projectile end of the casing.

* * * * *